US005659228A

United States Patent [19]

Ueda

[11] Patent Number: 5,659,228

[45] Date of Patent: Aug. 19, 1997

[54] CHARGED PARTICLE ACCELERATOR

[75] Inventor: Kouju Ueda, Tokyo, Japan

[73] Assignee: Mitsubishi Denki Kabushiki Kaisha, Tokyo, Japan

[21] Appl. No.: 418,862

[22] Filed: Apr. 7, 1995

Related U.S. Application Data

[63] Continuation of Ser. No. 42,982, Apr. 5, 1993, abandoned.

[30] Foreign Application Priority Data

| | | | |
|---|---|---|---|
| Apr. 7, 1992 | [JP] | Japan | 4-113249 |
| Apr. 7, 1992 | [JP] | Japan | 4-113250 |
| Apr. 21, 1992 | [JP] | Japan | 4-126699 |

[51] Int. Cl.[6] ..... H05H 9/00

[52] U.S. Cl. ..... 315/505; 315/5

[58] Field of Search ..... 315/505, 5.14, 315/5; 313/361.1

[56] References Cited

U.S. PATENT DOCUMENTS

| | | | |
|---|---|---|---|
| 3,067,347 | 12/1962 | Rose | 313/361.1 |
| 3,171,055 | 2/1965 | Harrison et al. | 315/5.41 |
| 3,218,562 | 11/1965 | Serduke | 328/233 |
| 3,239,712 | 3/1966 | Norris | 315/3.5 |
| 3,287,584 | 11/1966 | Pinel | 328/230 |
| 3,390,293 | 6/1968 | Nunan | 313/363.1 |
| 3,449,618 | 6/1969 | Gallagher | 315/5.41 |
| 3,463,959 | 8/1969 | Jory et al. | 315/5 |
| 3,482,136 | 12/1969 | Herrera | 313/361.1 |
| 3,541,328 | 11/1970 | Enge | 250/396 R |
| 3,887,832 | 6/1975 | Drummond et al. | 315/5.41 |
| 3,955,089 | 5/1976 | McIntyre et al. | 250/399 |
| 4,143,299 | 3/1979 | Sprangle et al. | 315/5.41 |
| 4,215,291 | 7/1980 | Friedman | 315/5.41 |
| 4,490,648 | 12/1984 | Lancaster et al. | 315/5.41 |
| 4,694,457 | 9/1987 | Kelly et al. | 372/2 |
| 4,712,042 | 12/1987 | Hamm | 315/5.41 |
| 4,801,847 | 1/1989 | Sakudo et al. | 315/5.41 |
| 5,084,682 | 1/1992 | Swenson et al. | 328/233 |

FOREIGN PATENT DOCUMENTS

| | | | |
|---|---|---|---|
| 20835 | 9/1965 | Japan | 313/361.1 |
| 07757 | 3/1967 | Japan | 313/361.1 |

OTHER PUBLICATIONS

Katsumi Tokiguchi, et al, "A Variable Energy RFQ for MeV Ion Implantation", 3rd European Particle Accelerator Conference.

*Primary Examiner*—Mark R. Powell
*Assistant Examiner*—Lawrence D. Richardson
*Attorney, Agent, or Firm*—Wolf, Greenfield & Sacks, P.C..

[57] ABSTRACT

A new charged particle accelerator with radio frequency quadrupole accelerating cavities is presented in this invention. Some focussing coils are mounted outside or inside several cavities of them. The accelerator emits charged particle whose kinetic energy can be varied as occasion demands.

6 Claims, 10 Drawing Sheets

CHARGED PARTICLE ACCELERATOR

This application is a continuation of application Ser. No. 08/042,982, filed Apr. 5, 1993, now abandoned.

BACKGROUND OF THE INVENTION

1. Field of the Invention

The invention relates to a charged particle accelerator which introduces charged particles into a radio frequency electro-magnetic field for accelerating the charged particles and obtaining a high kinetic energy, in particular relates to a heavy ion accelerator.

2. Description of the Prior Art

FIG. 9 and FIG. 10 show a conceptional construction of the charged particle accelerators with the conventional Radio Frequency Quadrupole (abbreviated as RFQ) type. FIG. 9 shows the H—H cross-section in FIG. 10, and FIG. 10 shows the G—G cross-section in FIG. 9. In these figures, the numeral 1 denotes an accelerating cavity, the numerals 2–5 denote flat electrodes which are arranged along a longitudinal direction of the accelerating cavity 1 and they are also arranged toward four radial directions from the rotationally symmetrical center of the accelerating cavity 1. The numeral 2 denotes the first electrode, and similarly the numeral 3, the second electrode, the numeral 4, the third electrode, and the numeral 5, the fourth electrode. The numeral 6 denotes the beam entrance which is prepared for introducing the charged particles and arranged at one end of the accelerating cavity 1.

The numeral 7 denotes the beam exit which is prepared for emitting the particles arranged at another end of the accelerating cavity 1. The numeral 8 denotes the beam axis which is linearly set up between the beam entrance 6 and the beam exit 7. The numeral 9 denotes a vacuum space which extends in all inner space of the accelerating cavity 1 except the space occupied by the four electrodes 2–5. The numeral 10 denotes a radio frequency coupler which is mounted on the outside of the accelerating cavity 1, and through which a desired radio frequency power is introduced into the accelerating cavity 1.

The conventional charged particle accelerator is constituted as described above. When the radio frequency power of the predetermined resonance frequency f is introduced into the accelerating cavity 1 through the radio frequency coupler 10, both of an electric field for accelerating the charged particles and a quadrupole electric field for preventing the diverging of the charged particles are formed on and near the beam axis 8, as well known by persons skilled in the art. The charged particle introduced from the beam entrance 6 gains a kinetic energy E at the beam exit 7 and are emitted from the beam exit 7.

In the case where the accelerating cavity 1 is a radio frequency quadrupole accelerating cavity, the following relationship is obtained.

$$E=Kf^2$$

where, each meaning of symbols is shown in the following.

E: an output kinetic energy of the charged particle at the beam exit 7, f: a resonance frequency, K: a constant which depends on the kinds of the charged particle and the construction of the accelerating cavity.

The kinetic energy is defined uniquely if the resonance frequency is decided.

Both intensities of the accelerating electric field and the quadrupole electric field depend on the waveforms of the front ends or the electric potentials of the four electrodes 2–5. Only the quadrupole electric field is described below in detail since the electric field is not directly concerned any more with the invention.

That is, the quadrupole electric field acts so as to converge or diverge the charged particles and it is able to transport the charged particles usefully by combining both effects of the convergence and the divergence under a little loss of particles. This quadrupole electric field is obtained, when both of the first electrode 2 and the third electrode 4 are maintained at a plus value in their electric potentials, and moreover the second electrode 3 and the fourth electrode 5 are maintained at a minus value in their electric potentials or vice versa, where the absolute value of the potential of the two electrodes, 3 and 5 is ideally equal to the absolute value of the potential of the two electrodes 2 and 4.

The quadrupole electric field strength seems to be able to increase infinitely with increasing electric potentials of these electrodes. However the strength is limited by electric breakdowns as well known by persons skilled in the art, and cannot be kept more than the strength corresponding to the electric breakdown potential.

As described above, the accelerating electric field and the quadrupole electric field in the charged particle accelerator depend on the wave shape of the front end or the electric potential of the first electrode 2, the second electrode 3, the third electrode 4 and the fourth electrode 5.

The quadrupole electric field having a good rotational symmetry with the beam axis 8 can be generated when the four electrodes 2–4, which are placed every 90° in rotated angle, are arranged at these precise positions.

A very high technique is necessary for arranging the first electrode 2, the second electrode 3, the third electrode 4 and the fourth electrode 5 in these predetermined precise positions. That is, if the first electrode 2, the second electrode 3, the third electrode 4 and the fourth electrode 5 are not arranged at these respective predetermined positions, such an electric field as deflects the charged particles on the beam axis 8, is often generated on and near the beam axis 8. Then a part of the charged particles can not reach the beam exit 7 and they may be lost in the accelerating cavity 1.

When the four electrodes 2–5 are not put within permissible errors together into the cylinder of the accelerating cavity 1, it often is necessary to re-machine and re-assemble in order to obtain the precise arrangement of the electrodes 2–5.

Furthermore, there is another problem that the kinetic energy of emitted charged particles can not be varied in compliance with any demand in the conventional charged particle accelerator as described in the above equation, since the emitted energy of the charged particles becomes nearly constant if the resonance frequency is introduced into the accelerating cavity 1.

SUMMARY OF THE INVENTION

It is an object of the present invention to provide a charged particle accelerator which has the following special features;

(1) The charged particles are prevented from diverting by equipping one or more magnetic field generation coils (which are called focussing coils in the following) inside or outside of the cavities, (2) The charged particles are deflected on an off-axis and returned to the beam axis by equipping one or more deflection coils in the cavities, (3) The kinetic energy of charged particles emitted from the accelerator can be variable by equipping one or more accelerating cavities with both of the focussing and deflection coils.

The charged particle accelerator is a linear accelerator which is called a RFQ with a radio-frequency quadrupole electric field generated by four electrodes per one cavity. Some kinds of focussing coils are presented here. A kind of the focussing coils is the coils wound upon the outside of the cavities, and another kinds of them are mounted in the cavities. Both of the focussing coils are solenoidal or doughnut-like, and each rotationally symmetrical axis is aligned coaxially with the beam axis. Therefore the magnetic field near the beam axis generated by the focussing coils is nearly parallel to the direction of the axis. The velocity component of the charged particles perpendicular to the beam axis is coupled with the magnetic field on a basis of physical principle, the coupling generates a restoring force that is, a focussing force toward the beam axis for the charged particles, themselves.

In RFQ accelerator the four electrodes in the cavities should be aligned rotationally symmetric, as it is required that the electric field on and near the beam axis is similarly symmetric. Unless the alignment of them is realized within enough accuracy to suppress a generation of an error field, such as a small deflecting field of the charged particles, the error field is generated on and near the beam axis, the charged particles are deflected by the field, and lost, for example, by colliding with the four electrodes, and so forth. The deflection coils in the cavities are mounted so as to generate a deflection field, and then can cancel the above-mentioned error field.

The kinetic energy of the charged particle emitted from the accelerator presented here can be variable by constituting of both types of cavities with and without the focussing coils. The charged particles through a cavity without the focussing coils are designed to have a good particle transmission with a constant energy gain only under a input power of radio frequency. Then this cavity without the radio frequency power can not only accelerate any charged particles but also they cannot frequently pass through itself without a loss of themselves, as a part of the kinetic energy of the particle injected into the cavity may be absorbed by interacting, for example, with the wall of the cavity, and then the interaction may produce so large beam size as to lose a major part of particles, for example, on the electrodes.

On the other hand, the cavity with the focussing coils can be designed to have a good particle transmission without any input power of radio frequency. Because in this cavity, a part of the kinetic energy of the particles injected into the cavity may be absorbed by interacting with the cavity, too, but a good transmission can be obtained in this cavity as the focussing coils prevents the beam size from enlarging under the interaction.

Therefore it is found to be able to select two states in the cavity, that is, one is the case with a energy gain and the other is one without any energy gain. The energy gap between two states results in a difference in the emitted kinetic energy.

Another aspect of the present invention is to provide a charged particle accelerator which further comprises of the following components;

(1) radio frequency couplers for introducing radio frequency powers into the accelerating cavities, (2) one or more partition walls which are mounted between two accelerating tubes, and separate one accelerating tube from another neighboring accelerating tube. Each wall has a hole through which the charged particles pass.

DETAILED DESCRIPTION OF THE PREFERRED EMBODIMENTS

Figure 1:
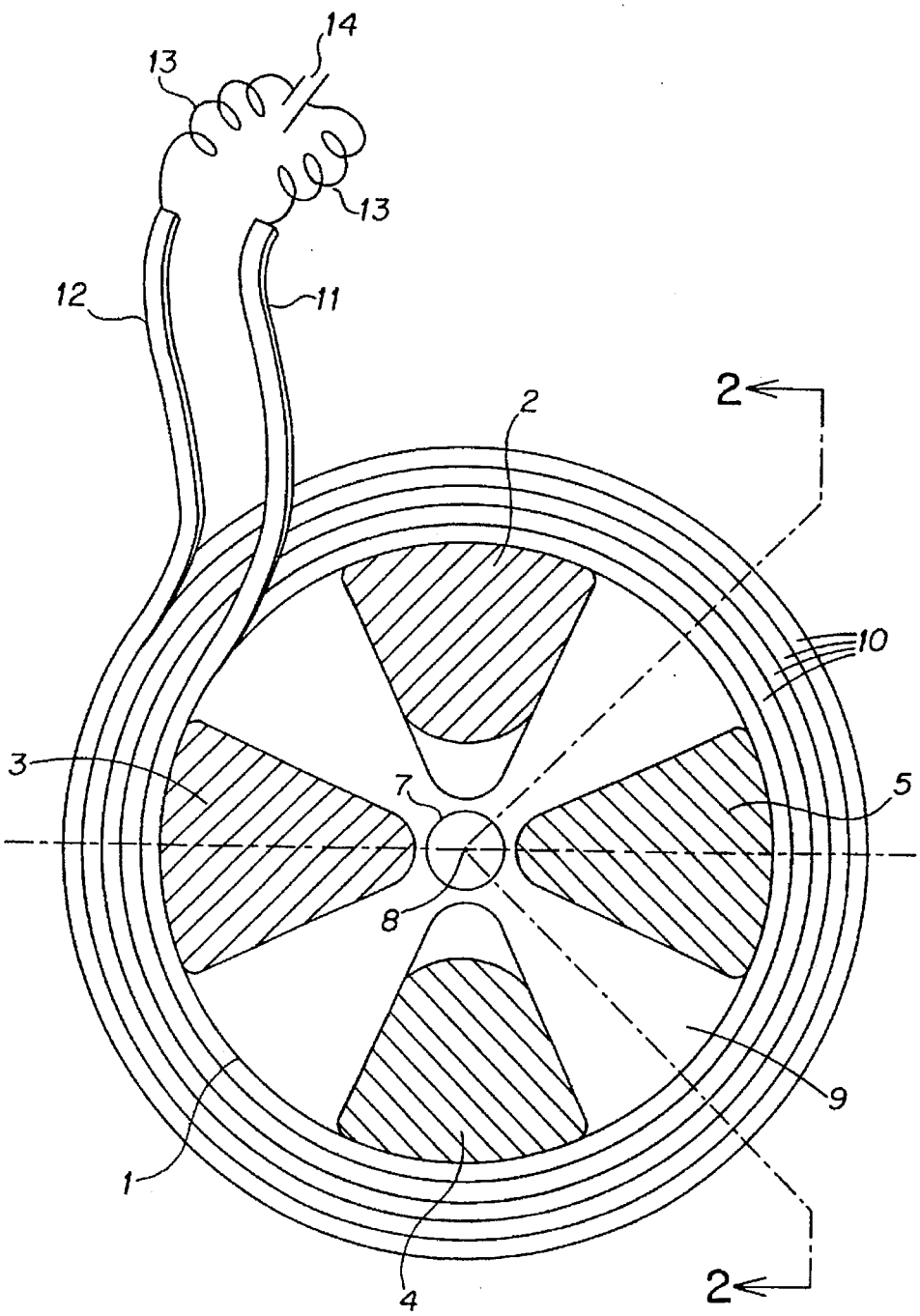
FIG. 1 is the first embodiment of the invention, that is, an example of the first kind of the focussing coils, and gives the B—B line cross-section in FIG. 2 where the A—A line cross-section in FIG. 1 is shown.
Figure 2:
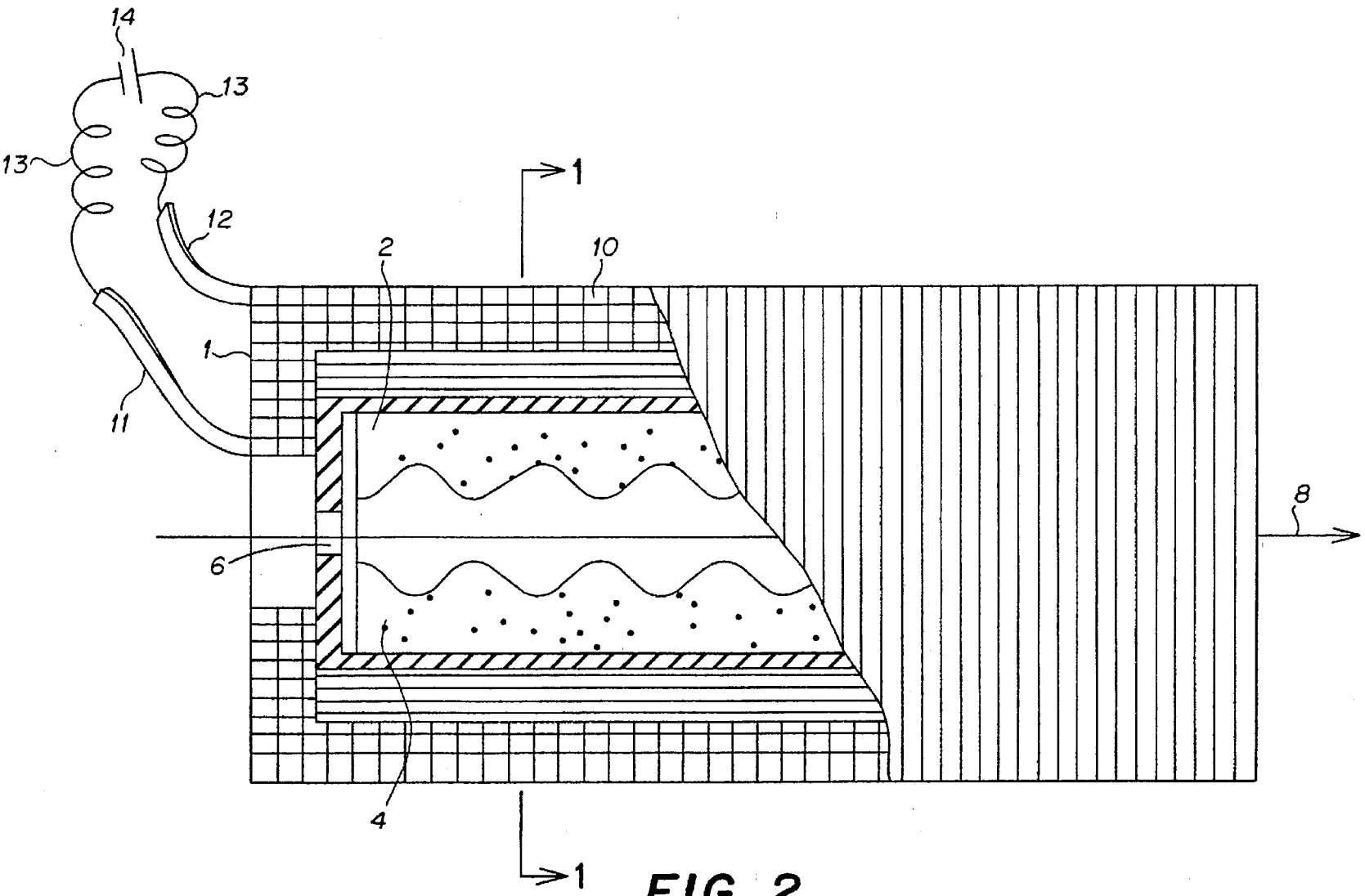

FIG. 1 is the first embodiment of the invention, that is, an example of the first kind of the focussing coils, and gives the B—B line cross-section in FIG. 2 where the A—A line cross-section in FIG. 1 is shown. In FIG. 1, the numeral 1 denotes an accelerating cavity, the numerals 2–5 are the first, the second, the third and the forth electrode, respectively, which are arranged every 90° in rotated angle around the symmetric axis of the accelerating cavity 1. The numeral 6 denotes the beam entrance which is arranged at one end of the accelerating cavity 1, and through which the charged particles are injected into the accelerating cavity 1. The numeral 7 denotes the beam exit which is arranged at another end of the accelerating cavity 1, and through which the particles are ejected outside the accelerating cavity 1. The numeral 8 is the beam axis which is formed linearly between the beam entrance 6 and the beam exit 7, and along which the charged particles are guided in the accelerating cavity 1. The numeral 9 denotes a vacuum space which extends in all inner space of the accelerating cavity 1 except the space occupied by the four electrodes 2–5. The numeral 10 denotes a magnetic field generation coil having a well known solenoid shape. The magnetic field generation coil is mounted around the outside of accelerating cavity 1, and is arranged co-axially with it so that the symmetric axis of the coils agrees with the beam axis 8 within permissible errors. The coil 10 receives current via current feeders 11 and 12 via power supply 14 and wires 13.

In the above charged particle accelerator, the magnetic field near the beam axis 8 generated by the magnetic field generation coil 10 is nearly parallel to the direction of the beam axis 8. The effect of this magnetic field on a paraxial beam of the charged particles is comparable to that of a centered system on a beam of light rays: the magnetic field created by the magnetic field generation coil 10 constitutes a magnetic lens and, under this meaning, the magnetic field generation coil 10 is called a focussing coil 10 in the following.

By aligning the accelerating cavity 1 coaxially with the focussing coil 10, a focussing effect other than the quadrupole lens with the conventional RFQ is obtained, and this will play the important part of suppressing the increasing divergence due to both of the above-mentioned interaction of the wall with the charged particles, and the space charge effect as well known from the physical principle, with increasing charged particle's intensity.

Embodiment 2

Figure 3:
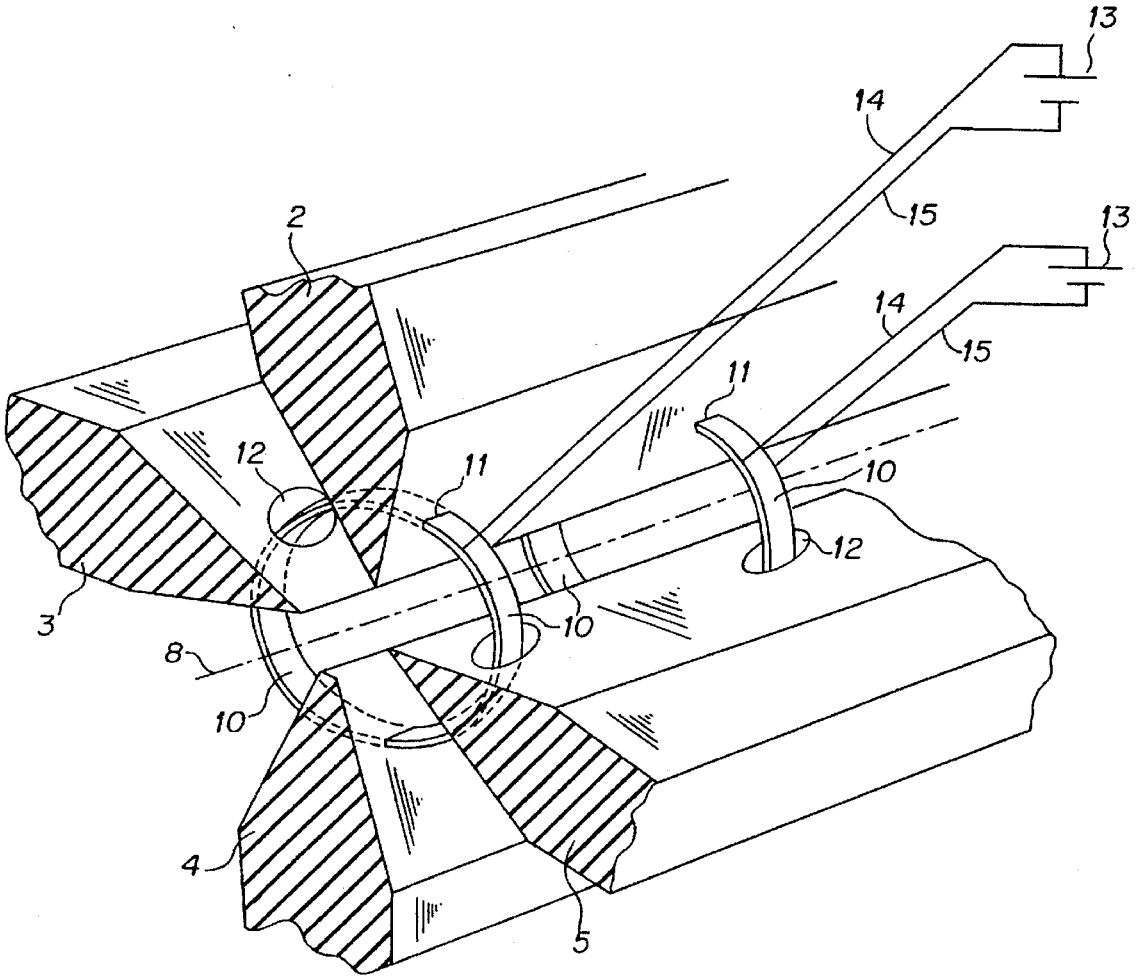
FIG. 3 is an enlarged perspective view of the second embodiment, that is, an example of the other kinds of the present invention, and shows a mutual relation of focussing coils with the four electrodes.

FIG. 3 is an enlarged perspective view of the second embodiment of the present invention, that is, an example of the other kinds, and shows a mutual relation of the focussing coils with the four electrodes. The numeral 10 is donut-like focussing coils which are fixed at the respective fixed portions 11. The coils 10 are passed through the coil penetration portions 12 with an appropriate vacuum gap and insulated from the penetration portions 12. The reference numbers in FIG. 3 are the same as those used for the same portions or the corresponding portions in FIG. 1 and FIG. 2. Additionally, conductors 14–15 receive exciting currents from wires 14 and 15 via power supply 13 and provide such current to the focussing coils 10.

The charged particle accelerator can be constructed as described above as the electric potential of the first electrode 2 is the same as the potential of the third electrode 4. Since the second electrode 3 and the fourth electrode 5 are the same electric potential, but the potential of the first and the third electrodes 2 and 4 and the potential of the second and the fourth electrodes 3 and 5 are opposite in sign each other.

In the present second embodiment, the focussing coil 10 is aligned coaxially with the accelerating cavity 1. Therefore, the same effect as in FIG. 1 and FIG. 2 is obtained as described above.

The focussing coils 10 of FIG. 3 intermit along the longitudinal direction of the four electrodes. The coils 10 can be designed thickly or thinly as occasion demands. The respective focussing coils 10 can generate their desired magnetic field strengths. Therefore, the respective focussing coils 10 can respond to the respective requirements for their local field strength.

Embodiment 3

Figure 4:
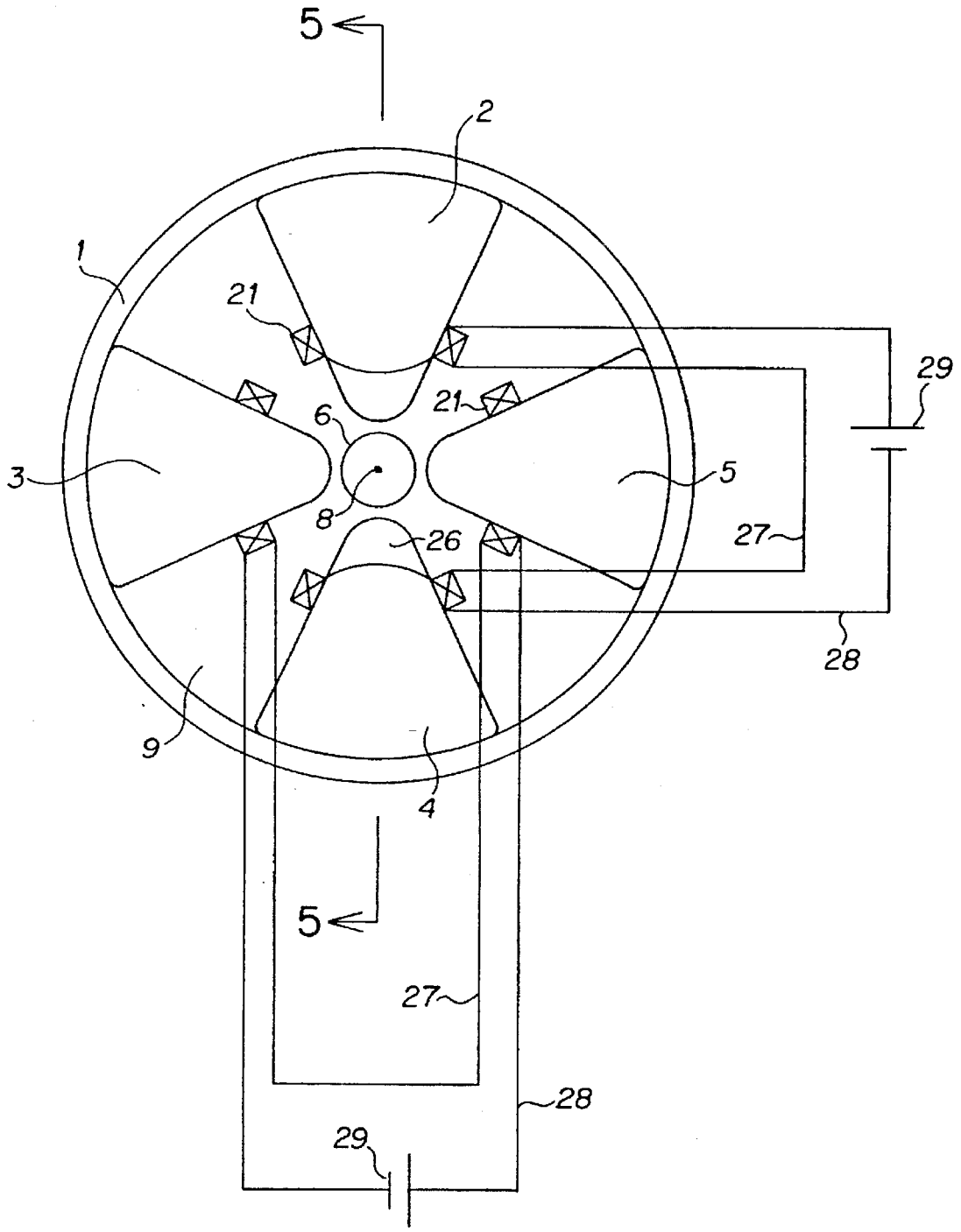
FIG. 4 is the third embodiment of the invention, that is, an example of the deflection coils, and give the D—D line cross-section in FIG. 5 where the C—C line cross-section in FIG. 4 is shown.
Figure 5:
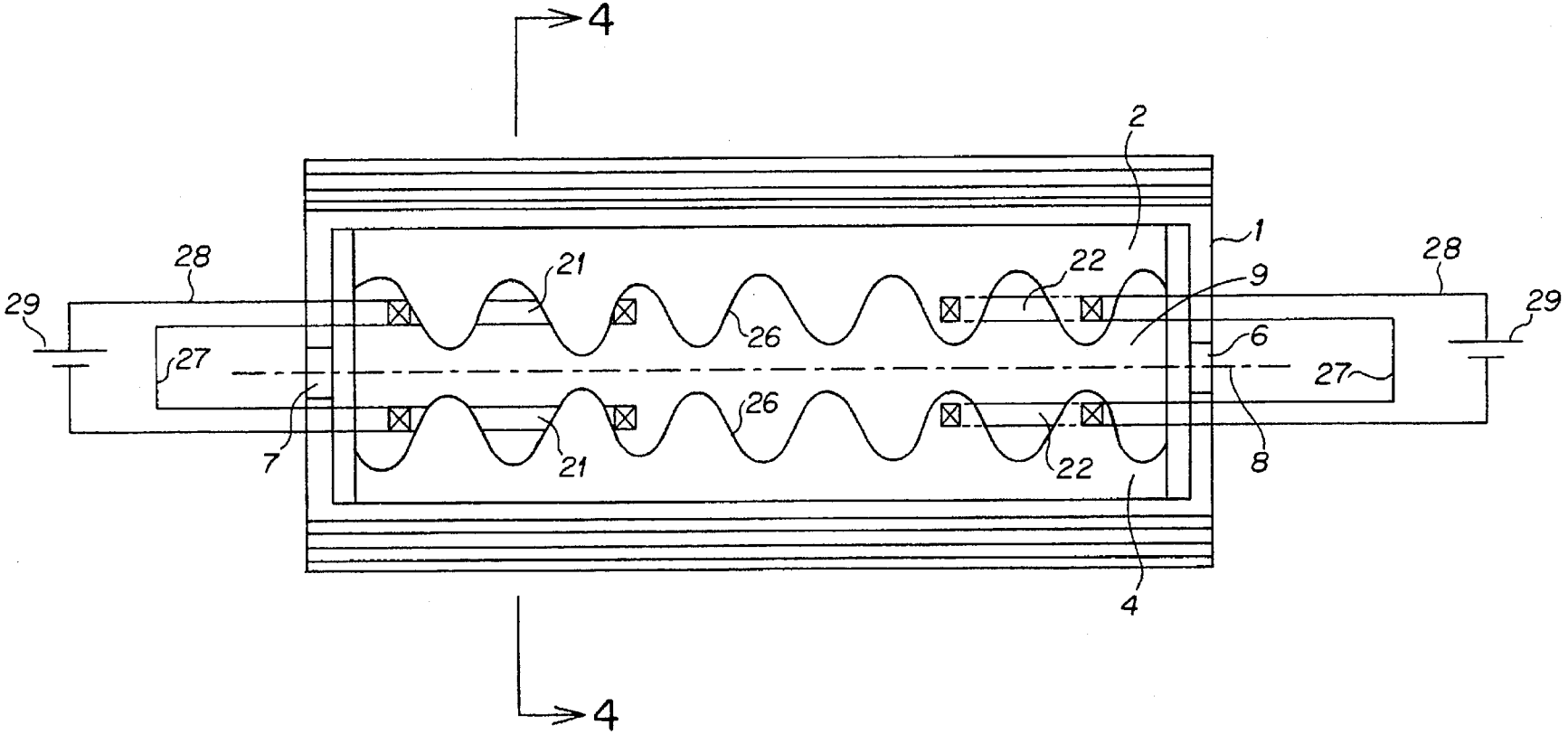

FIG. 4 is the third embodiment of the invention, that is, an example of the deflection coils, and gives the D—D line cross-section in FIG. 5 where the C—C line cross-section in FIG. 4 is shown. In FIG. 4, the numeral 1 denotes an accelerating cavity, the numerals 2–5 denote four electrodes each of which has a plate shape. The plate-shaped electrodes are mounted in the same way as described in FIG. 1, and the end surface facing the beam axis of each electrode forms a wave shape 26. The reference numbers in FIG. 4 and FIG. 5 are the same as those used in FIG. 1, FIG. 2 and FIG. 3 for the same portions or the corresponding portions.

The numerals 21 and 22 denote two kinds of deflection coils. The numeral 21 is called A type of deflection coils which are mounted at valley portions of the waveforms with both of the first electrode 2 and the third electrode 4. The magnetic fields produced by these A type of deflection coils are called the first magnetic field. The numeral 22 is called B type of deflection coils which penetrate through both of the first electrode 2 and the third electrode 4. Both types can produce magnetic fields in a direction perpendicular to the beam axis 8. A description of the A type coil follows.

The operation of the third embodiment is described below in the case of the A type of deflection coil 21. The A type of deflection coil of the first electrode 2 is connected in series with the A type of deflection coil of the third electrode 4. Additionally, the A type of deflection coil are insulated from both of the electrodes 2 and 4. The exciting current of both of the A type of deflection coil is given by a power supply 29. Wires 27 and 28 provide the exciting current to the coils. Wires 27 and 28 pass through holes 31 and vacuum sealing portion 30. The A type deflection coil generate a magnetic field perpendicular to the beam axis 8. The field is called the first magnetic field here, and deflects the charged particles which are off the beam axis 8 and may collide the electrodes, and so forth. Consequently, the deflected particles can return toward the beam axis 8, and can keep the losses at a minimum.

The A type of deflection coil 21 are similarly mounted at valley portions of the waveforms with both of the second electrode 3 and the fourth electrode 5. Also a pair of the these deflection coils is insulated from both of the electrodes, 3 and 5. The exciting current of both deflection coils is given by a power supply, too. These deflection coils generate a magnetic field perpendicular to the beam axis 8, whose magnetic field is called the second magnetic field here.

The first magnetic field and the second magnetic field transverse each other. The charged particle off the beam axis 8, and moreover on the deflection surface parallel to the first magnetic field can be given back to the direction of the beam axis 8 by applying the second magnetic field. In the same way, the charged particle off the beam axis 8, and moreover on the deflection surface parallel to the second magnetic field can be given back to the direction of the beam axis 8 by applying the first magnetic field.

In the third embodiment of the present invention, the deflection coils are mounted so as to generate nearly homogeneous magnetic fields along the beam axis in the accelerating cavity. The fluctuations of the paths of charged particles can be controlled to keep at a minimum, and then the accelerator which effectively accelerates the charged particles can be easily obtained.

Embodiment 4

Figure 6:
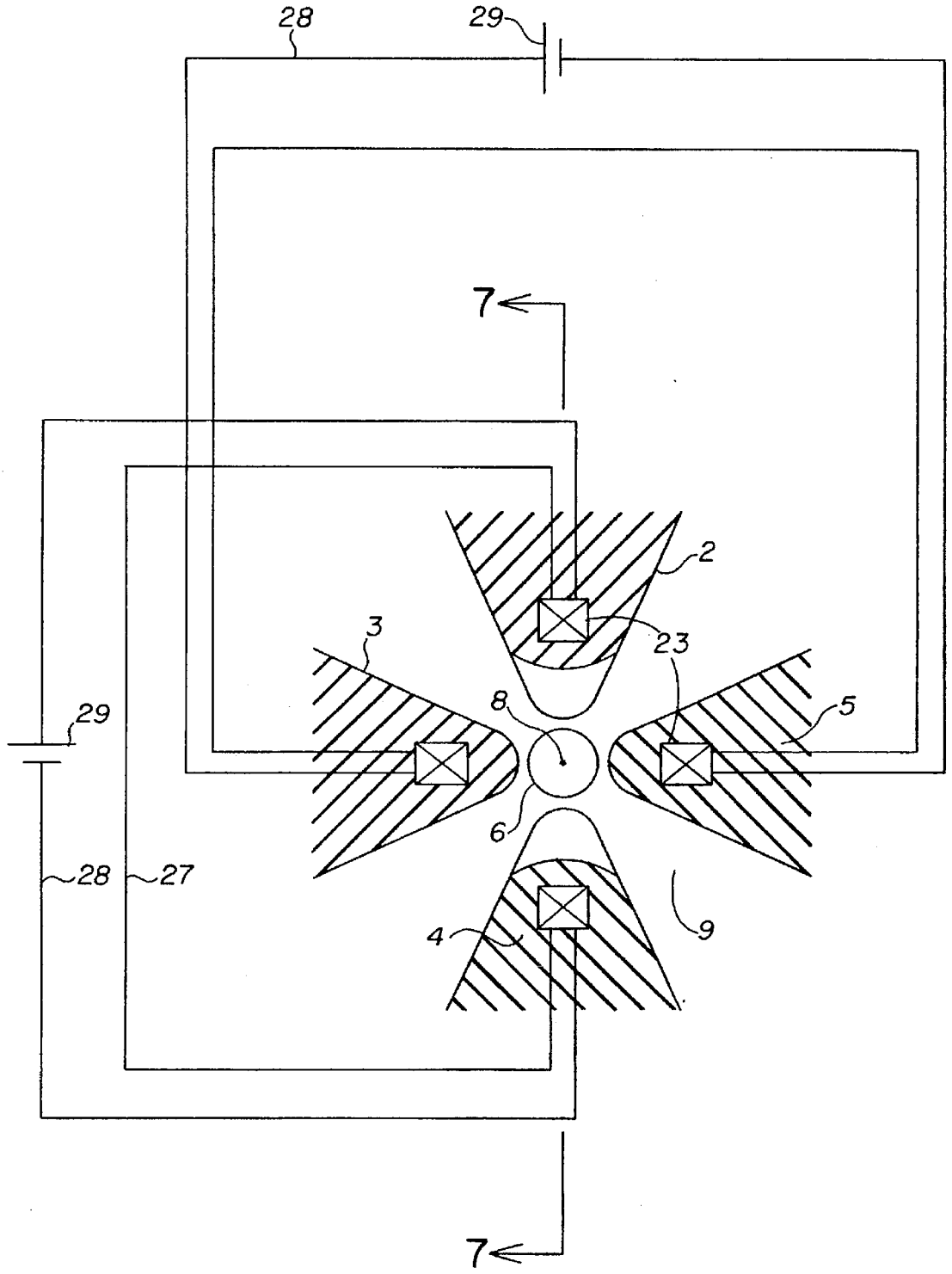
FIG. 6 is the forth embodiment of the invention, that is, one more example of the deflection coils, and shows the F—F line cross-section in FIG. 7 where the E—E cross section in FIG. 6 is shown.
Figure 7:
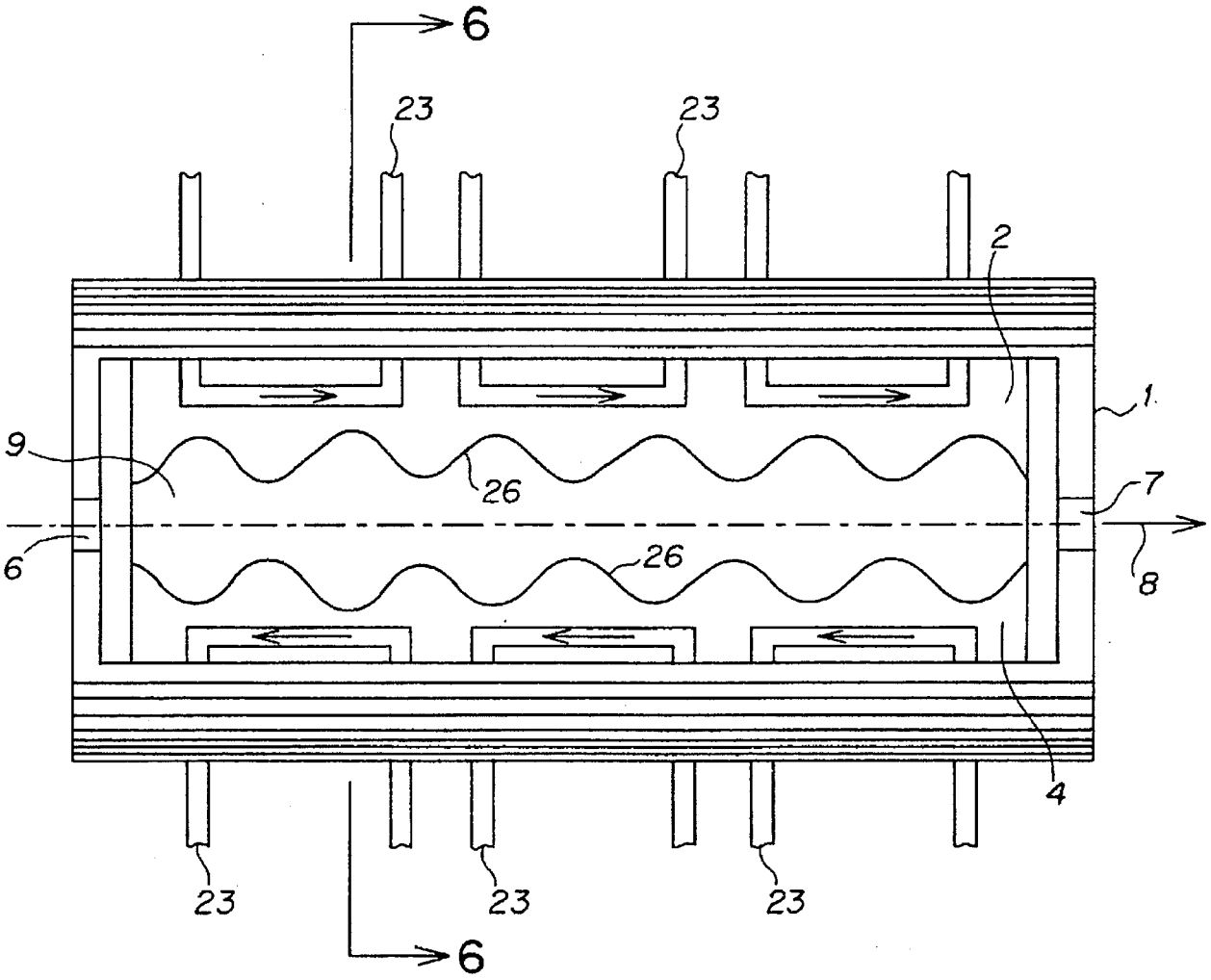

FIG. 6 is the fourth embodiment of the invention, the other example of the deflection coils, and gives the F—F line cross-section in FIG. 7, where the E—E line cross-section in FIG. 6 is shown. The numeral 23 denotes the third deflection coils having a single wire coil shape which is mounted in both of the first electrode 2 and the third electrode 4. The reference numbers in FIG. 6 and FIG. 7 are the same as those used in FIG. 1 and FIG. 2 for the same portions or the corresponding portions.

The third deflection coils 23 differ from both of the A type of deflection coil and the B type of coil 22 which have the rectangular shapes as shown in FIG. 4 and FIG. 5. The homogeneity of the magnetic field due to the third coils is inferior compared with that of the first or the second deflection coils, but the third coils have a simple construction, and then is easily manufactured.

The third deflection coil 23 of the first electrode 2 and the third deflection coil 23 of the third electrode 4 are connected, for example, in series in the same way as described in the case of the first deflection coils 21. Such deflection coils are mounted in the second and the fourth electrodes 3 and 5, and the third deflection coil 23 of the second electrode 3 are connected in series with the third deflection coils 23 of the fourth electrode 5, too.

The charged particle which is deflected far from the beam axis 8 by the influence of the electrical field is corrected toward the direction of the beam axis 8 by applying the magnetic field in the same way as described above. Therefore, the detailed explanation is omitted.

Embodiment 5

Figure 8:
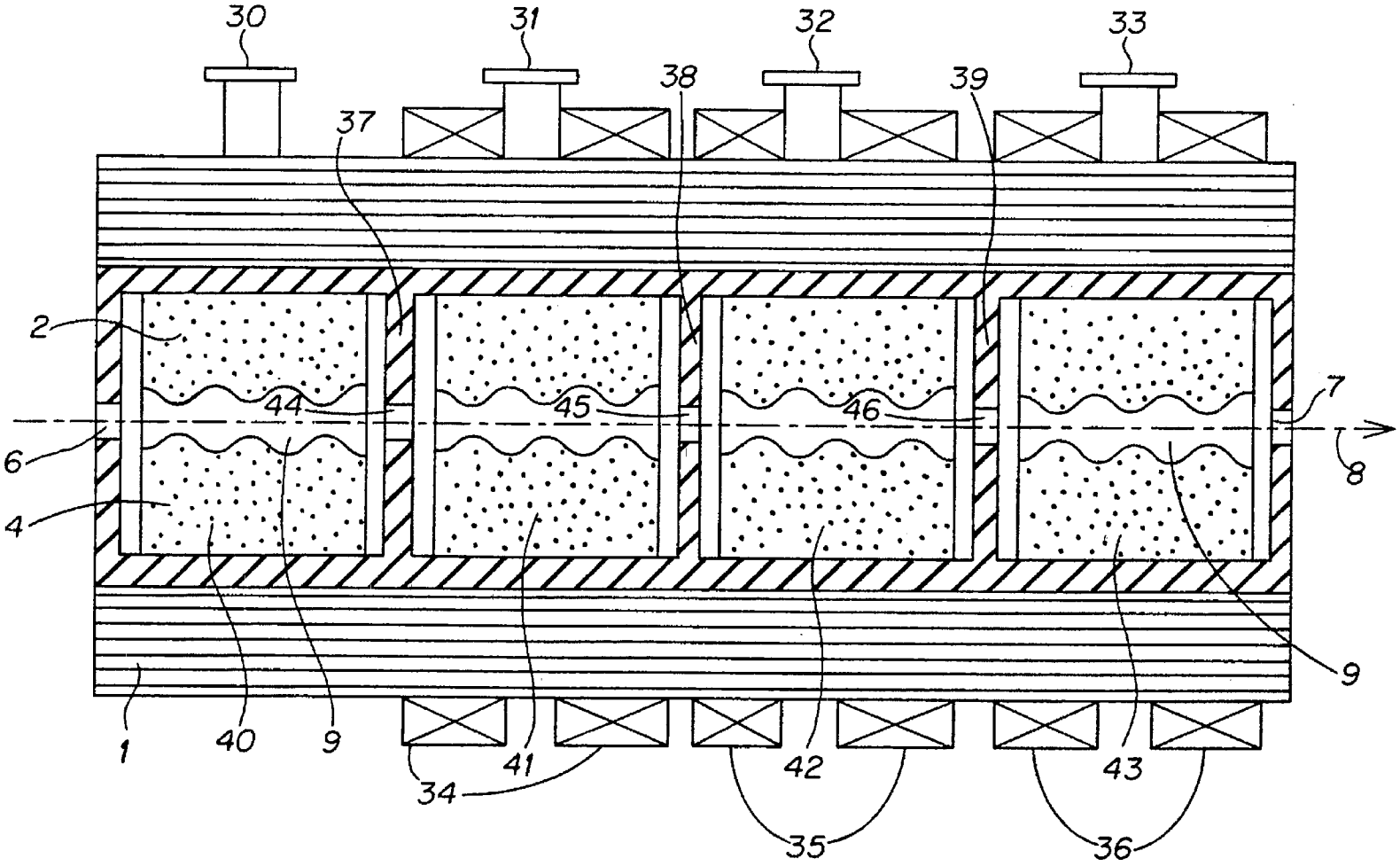
FIG. 8 is the fifth embodiment of the invention, that is, an example of the charged particle accelerator which can provide the charged particles of the variable kinetic energy which, of course, is not continuously variable.
Figure 9:
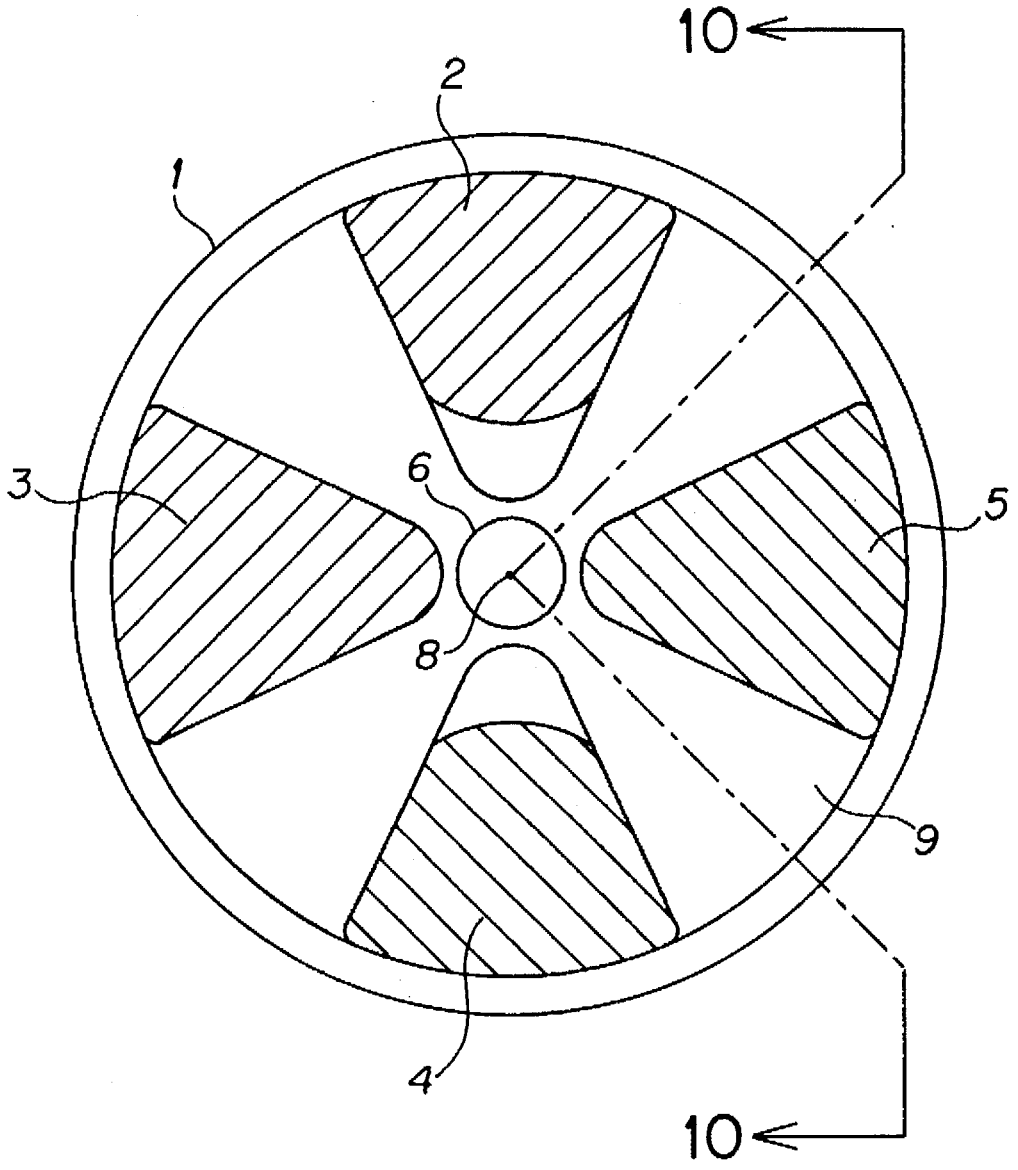
FIG. 9 is the conventional charged particle accelerator, and gives the H—H line cross-section in FIG. 10 where the G—G line cross-section in FIG. 9 is shown.

FIG. 8 is the fifth embodiment of the invention, that is, an example of the accelerator which can provide the charged particle whose kinetic energy can be varied as occasion demands, and yet is not continuously variable. The numerals 30–33 are radio frequency couplers mounted to the accelerating cavity 1. The numeral 30 is the first radio frequency coupler, and similarly the numeral 31, the second radio frequency coupler, the numeral 32, the third radio frequency coupler, and the numeral 33, the fourth radio frequency coupler.

The numerals 34–36 are the magnetic field generation coils, for example, the first kind of the focussing coils in FIG. 1 and FIG. 2.

Figure 10:
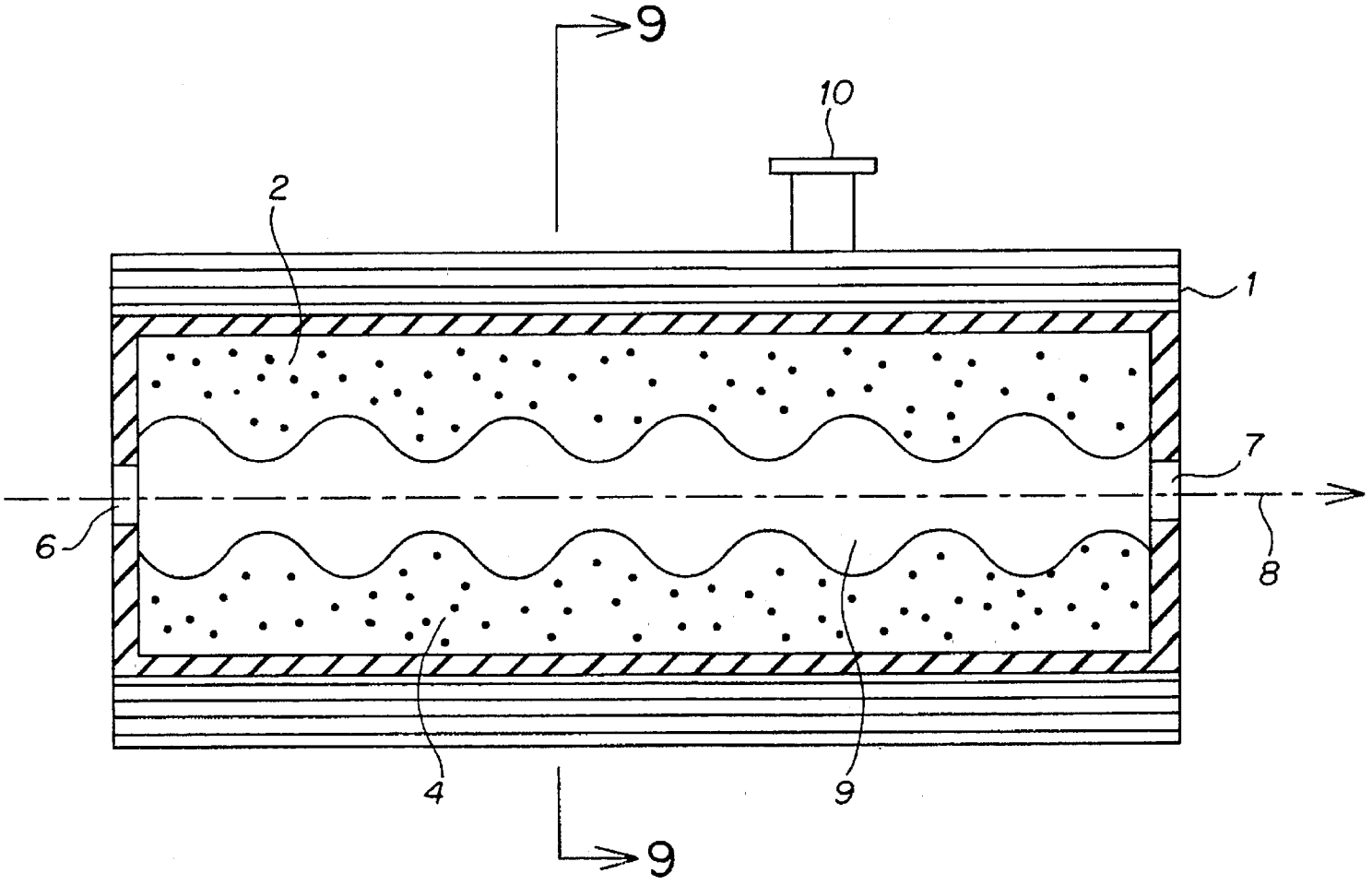

The numerals 40–43 denote accelerating tubes which accelerate the charged particles and are the same type as the accelerating cavity in FIG. 10. The numeral 40 is the first accelerating tube, that is, a cavity without the focussing coils and with the first radio frequency coupler. The numerals 41–43 are the second, the third and the forth accelerating tubes with both of the focussing coils and the radio frequency coupler, respectively.

Each radio frequency power which is introduced into each accelerating cavity through the radio frequency coupler excites the corresponding cavity and generates an accelerating field and a quadrupole electric field on and around the beam axis.

The numerals 37–39 denote partition walls each of which is mounted in order to separate one accelerating tube from another neighboring accelerating tube. The numeral 37 denotes the first partition wall which separates the first accelerating tube 40 from the second accelerating tube 41. Similarly the numerals 38 and 39 denote the second and the third partition walls, respectively. The former separates the second accelerating tube 41 from the third accelerating tube 42, and the later separates the third accelerating tube 42 from the fourth accelerating tube 43.

The accelerating tube 40 is arranged between the beam entrance 6 and the first partition wall 37, and the accelerating tube 43 is arranged between the third partition wall 39 and the beam exit 7.

The numerals 44–46 denote beam pass holes, respectively. Their sizes are so small that little part of the radio frequency power of a cavity can come into the neighboring cavities. The numeral 44 denotes the first beam pass hole which is mounted at the center of the first partition wall 37. The numeral 45 denotes the second beam pass hole which is mounted at the center of the second partition wall 38. The numeral 46 denotes the third beam pass hole which is mounted at the center of the third partition wall 39.

In the charged particle accelerator described above, the first accelerating tube 40, the second accelerating tube 41, the third accelerating tube 42 and the fourth accelerating tube 43 can be excited independently through the first radio frequency coupler 30, the second radio frequency coupler 31, the third radio frequency coupler 32 and the fourth radio frequency coupler 33, respectively. And then an accelerated electric field and a focusing electrical field are generated independently in the respective accelerating tube, too.

The charged particles are introduced from the beam entrance 6 and pass through the first beam pass hole 44, the second beam pass hole 45, and the third beam pass hole 46, in turn, and emitted from the beam exit 7.

The charged particle having the maximum kinetic energy is obtained when the first accelerating tube 40, the second accelerating tube 41, the third accelerating tube 42 and the fourth accelerating tube 43 are all excited at the same time, by introducing the desired respective radio frequency powers through the first radio frequency coupler 30, the second radio frequency coupler 31, the third radio frequency coupler 32 and the fourth radio frequency coupler 33.

The charged particle having the minimum kinetic energy is obtained when the radio frequency power is introduced only through the first radio frequency coupler 30 and not introduced from other radio frequency couplers 31, 32 and 33. In case that the radio frequency power is introduced only through the first radio frequency coupler 30 except for other remaining radio frequency couplers 31–33, induction fields which are generated by the charged particles and result in losses of them, are generated in the accelerating tubes, 41–44, while the charged particle is passing therethrough. In this case, for example, if the first, second and third magnetic field generation coils 34, 35, 36 are excited, each desired magnetic field is generated on and near the beam axis 8 so as to prevent the charged particle from colliding with the electrodes and the partition walls, and the charged particles are emitted with a minor loss from the beam axis 7.

Thus by introducing the radio frequency power selectively through some of the first radio frequency coupler 30, the second radio frequency coupler 31, the third radio frequency coupler 32 and the fourth radio frequency coupler 33, the kinetic energy of the emitted charged particles can be easily varied as though the value is variable only step by step, by applying the constant resonance frequency at the range of accelerating energy from maximum to minimum.

It is apparent that less or more than four accelerating tubes may be operated in the same way described above, though an example of four accelerating tubes 40, 41, 42 and 43 is given as the fifth embodiment shown in FIG. 8.

Also it is clear that the same operation of FIG. 8 may be obtained if these magnetic field generation coils having doughnut-like are equipped coaxially with the beam axis 8 inside the accelerating cavity 1.

In an example in FIG. 8, the accelerating tube 40 does not have the focussing coils. It is clear that the accelerating tube 40 with the focussing coils can be operated in the same way described above, too.

Those skilled in the art will recognize which many modifications to the foregoing description can be made without departing from the spirit of the invention. The foregoing description is intended to be exemplary and in no way limiting. The scope of the invention is defined in the appended claims and equivalents thereto.

What is claimed is:

1. A charged particle accelerator for accelerating a beam of charged particles, comprising:

an accelerating cavity having a length, including four electrodes disposed along the length radially from a symmetrical axis of the accelerating cavity; and a magnetic field generating coil mounted through a coil penetration portion of each of the four electrodes within the length of the accelerating cavity and in coaxial relation with the symmetrical axis to provide a magnetic field within the accelerating cavity in response to an external excitation of the magnetic field generating coil, the magnetic field suppressing a divergence of the beam of charged particles within the accelerating cavity.

2. The charged particle accelerator of claim 1, wherein the coil penetration portion of two opposite electrodes of the four electrodes includes a vacuum gap, so that the magnetic field generation does not electrically contact the two of the four electrodes.

3. The charged particle accelerator of claim 1, further comprising:

a first radio frequency coupler connected to the accelerating cavity;

a second accelerating cavity axially aligned with the accelerating cavity, having a second length, including four electrodes disposed radially from the symmetrical axis of the accelerating cavity;

a second radio frequency coupler connected to the second accelerating cavity; and a second magnetic field generating coil mounted within the length of the second accelerating cavity and in coaxial relation with the symmetrical axis.

4. The charged particle accelerator of claim 3, wherein at least one of the first radio frequency coupler and the second radio frequency coupler is operable to control a kinetic energy of a charged particle.

5. The charged particle accelerator of claim 3, further including a wall, mounted between the accelerating cavity and the second accelerating cavity, the wall having portions defining a beam pass hole.

6. The charged particle accelerator of claim 1, wherein the divergence of the beam of charged particles is caused by at least one of interaction with a wall of the charged particle accelerator and a space charge affect.

* * * * *

UNITED STATES PATENT AND TRADEMARK OFFICE

CERTIFICATE OF CORRECTION

PATENT NO. : 5,659,228

DATED : August 19, 1997

INVENTOR(S): Kouju Ueda

It is certified that error appears in the above-identified patent and that said Letters Patent is hereby corrected as shown below:

In column 6, lines 6-7, please delete the following:

Wires 27 and 28 pass through holes 31 and vacuum sealing portion 30.

Signed and Sealed this

Seventeenth Day of March, 1998

*Attest:*

*Attesting Officer*

BRUCE LEHMAN

*Commissioner of Patents and Trademarks*